US010219549B2

(12) United States Patent
Ward

(10) Patent No.: US 10,219,549 B2
(45) Date of Patent: Mar. 5, 2019

(54) ULTRA LOW PROFILE TOE COVERLET

(71) Applicant: Kelly Ward, Holly Springs, NC (US)

(72) Inventor: Kelly Ward, Holly Springs, NC (US)

(73) Assignee: Kelly Ward, Holly Springs, NC (US)

( * ) Notice: Subject to any disclaimer, the term of this patent is extended or adjusted under 35 U.S.C. 154(b) by 0 days.

(21) Appl. No.: 15/649,968

(22) Filed: Jul. 14, 2017

(65) Prior Publication Data

US 2018/0014578 A1 Jan. 18, 2018

Related U.S. Application Data

(60) Provisional application No. 62/362,670, filed on Jul. 15, 2016.

(51) Int. Cl.

| | |
|---|---|
| ***B65D 85/18*** | (2006.01) |
| ***A41B 11/00*** | (2006.01) |
| ***A41B 17/00*** | (2006.01) |
| ***B65D 25/54*** | (2006.01) |

(52) U.S. Cl.

CPC ..... *A41B 11/001* (2013.01); *A41B 17/00* (2013.01); *B65D 25/54* (2013.01); *B65D 85/18* (2013.01)

(58) Field of Classification Search

CPC ..... A41B 11/001; A41B 11/004; B65D 25/54
USPC ..... 206/278; 2/61, 239
See application file for complete search history.

(56) References Cited

U.S. PATENT DOCUMENTS 2,391,064 A * 12/1945 McCandless ..... A43B 23/28 2/239
2,443,997 A * 6/1948 Town ..... A43B 23/28 2/61
2,596,211 A * 5/1952 Comfort ..... A61F 13/043 2/240
2,687,528 A * 8/1954 Paul ..... A43B 23/28 2/239
2,985,297 A * 5/1961 Berry ..... B65D 85/18 206/278
3,193,137 A * 7/1965 McCarthy ..... B65D 83/0805 206/278
3,286,831 A * 11/1966 Giberstein ..... B65B 25/20 206/278
3,334,356 A * 8/1967 Abel ..... A43B 23/28 128/894
3,901,001 A * 8/1975 Glaze, Jr. ..... B65B 25/20 206/278
3,908,822 A * 9/1975 Giberstein ..... B65D 77/062 206/278
6,735,988 B1 * 5/2004 Honeycutt ..... A41B 11/00 2/239
D524,036 S * 7/2006 Gardner ..... D2/980
(Continued)

FOREIGN PATENT DOCUMENTS

GB 1237908 * 7/1971

OTHER PUBLICATIONS

Microfiber Slingback Liner with Clear, Hidden Slingback Strap, *George*, One Size, 2 Pair, Mid, Admitted Prior Art.

(Continued)

*Primary Examiner* — Sue A Weaver
(74) *Attorney, Agent, or Firm* — Ward and Smith, P.A.

(57) ABSTRACT

Toe coverlets are provided including a flexible material configured to be positioned over the toes of a foot such that spacing between the toes of the foot is visible and does not extend onto a ball of the foot. Related systems are also provided.

20 Claims, 14 Drawing Sheets

(56) References Cited

U.S. PATENT DOCUMENTS

| | | | | |
|---|---|---|---|---|
| 2005/0022421 | A1* | 2/2005 | Bruckner | A43B 5/12 36/8.3 |
| 2015/0026868 | A1* | 1/2015 | Sherry | A41B 11/004 2/239 |
| 2015/0374094 | A1* | 12/2015 | Gift | A45D 29/22 36/94 |

OTHER PUBLICATIONS

Toe Covers, Super soft comfort for closed in shoes, *footfashion*, 2 pair pack, Admitted Prior Art.
Goofy looking but save my toes from certain death, Admitted Prior Art.
Lingerie for Your Toes, Lingerie for Your Legs, *by Vicki Kysella, Voet*, Admitted Prior Art.

* cited by examiner

ULTRA LOW PROFILE TOE COVERLET

CLAIM OF PRIORITY

The present application claims priority to U.S. Provisional Application No. 62/362,670 entitled Ultra Low Profile Toe Coverlet, filed on Jul. 15, 2016, the disclosure of which is hereby incorporated herein by reference as if set forth in its entirety.

FIELD

The present inventive concept relates generally to clothing and, more particularly, to toe coverings.

BACKGROUND

Women love shoes, especially high heel shoes, but generally hate panty hose. When the weather is warm or in climates that remain warm all year round, women tend to wear their shoes without hose, thigh highs, knee highs or socks. Socks may not look attractive with certain shoes; hose is uncomfortable as are thigh highs and knee highs. However, wearing shoes without socks or hose can cause the shoes to slip as the foot sweats and may damage any polish that may be present on the toe nails. Many solutions are provided in the market, but these solutions generally require wearing an uncomfortable foot cover that is visible outside the perimeter of the shoe. For example, there is one product that covers the whole foot that often slips off the back of the heel and is visible outside the perimeter of the shoe. There is also a product that is a half sock that extends over the ball of foot causing a loss of traction that is also unattractively visible.

SUMMARY

Some embodiments of the present inventive concept provide a toe coverlet including a flexible material configured to be positioned over the toes of a foot such that spacing between the toes of the foot is visible and does not extend onto a ball of the foot.

In further embodiments, the flexible material may include one of cotton, nylon, spandex and a combination thereof.

In still further embodiments, toe nails on the toes may be completely covered by the flexible material of the toe coverlet to provide protection of any paint present on the toe nails.

In some embodiments, the flexible material may expose the ball of the foot such that the exposed ball of the foot provides a gripping function for the foot within a shoe.

In further embodiments, presence of the toe coverlet on the toes of the foot may assist positioning of the foot in a shoe.

In still further embodiments, the toe coverlet may be provided as a one size fits all item or in one of a kid size and an adult size.

In some embodiments, the flexible material may be provided having patterns thereon.

In further embodiments, the flexible material may not visible outside a perimeter of a shoe when the toe coverlet is positioned on the foot in the shoe.

In still further embodiments, the flexible material may just barely wraps around the toes of the foot.

Some embodiments of the present inventive concept provide a system including a housing; and a plurality of pairs of toe coverlets positioned in the housing. The plurality of pairs of toe coverlets include a flexible material configured to be positioned over the toes of a foot such that spacing between the toes of the foot is visible and does not extend onto a ball of the foot.

In further embodiments, the housing may include decorative packaging to appeal to purchasers of the system.

In still further embodiments, the decorative packaging may include one of plastic and cardboard.

In some embodiments, the decorative packaging may include a window on the packaging that allows the plurality of pairs of toe coverlets to be viewed therein.

BRIEF DESCRIPTION OF THE DRAWINGS

The accompanying drawings, which are included to provide a further understanding of the disclosure and are incorporated in and constitute a part of this application, illustrate certain non-limiting embodiment(s) of the inventive concept. In the drawings.

DETAILED DESCRIPTION

In the following detailed description, numerous specific details are set forth in order to provide a thorough understanding of the inventive concept. However, it will be understood by those skilled in the art that the present inventive concept may be practiced without these specific details.

As discussed in the background, women love shoes, especially high heel shoes, but generally hate panty hose. When the weather is warm or in climates that remain warm all year round, women tend to wear their shoes without hose, thigh highs, knee highs or socks. Socks may not look attractive with certain shoes; hose is uncomfortable as are thigh highs and knee highs. However, wearing shoes without socks or hose can cause the shoes to slip as the foot sweats and may damage any polish that may be present on the toe nails. Many solutions are provided in the market, but these solutions generally require wearing an uncomfortable foot cover that is visible outside the perimeter of the shoe. For example, there is one product that covers the whole foot that often slips off the back of the heel and is visible outside the perimeter of the shoe. There is also a product that is a half sock that extends over the ball of foot causing a loss of traction that is also unattractively visible.

Accordingly, embodiments of the present inventive concept provide an ultra low profile toe coverlet that is not visible outside the perimeter of the shoe and also does not extend under the ball of the foot allowing for comfortable traction and the reduction or, possible avoidance, of slipping. Thus, embodiments of the present inventive concept provide protection for the toes including pedicures as well as allowing the foot to be positioned in the shoe easily. The exposed ball of the foot allows avoidance of slipping as will be discussed below with respect to FIGS. 1 through 11C.

Figure 1:
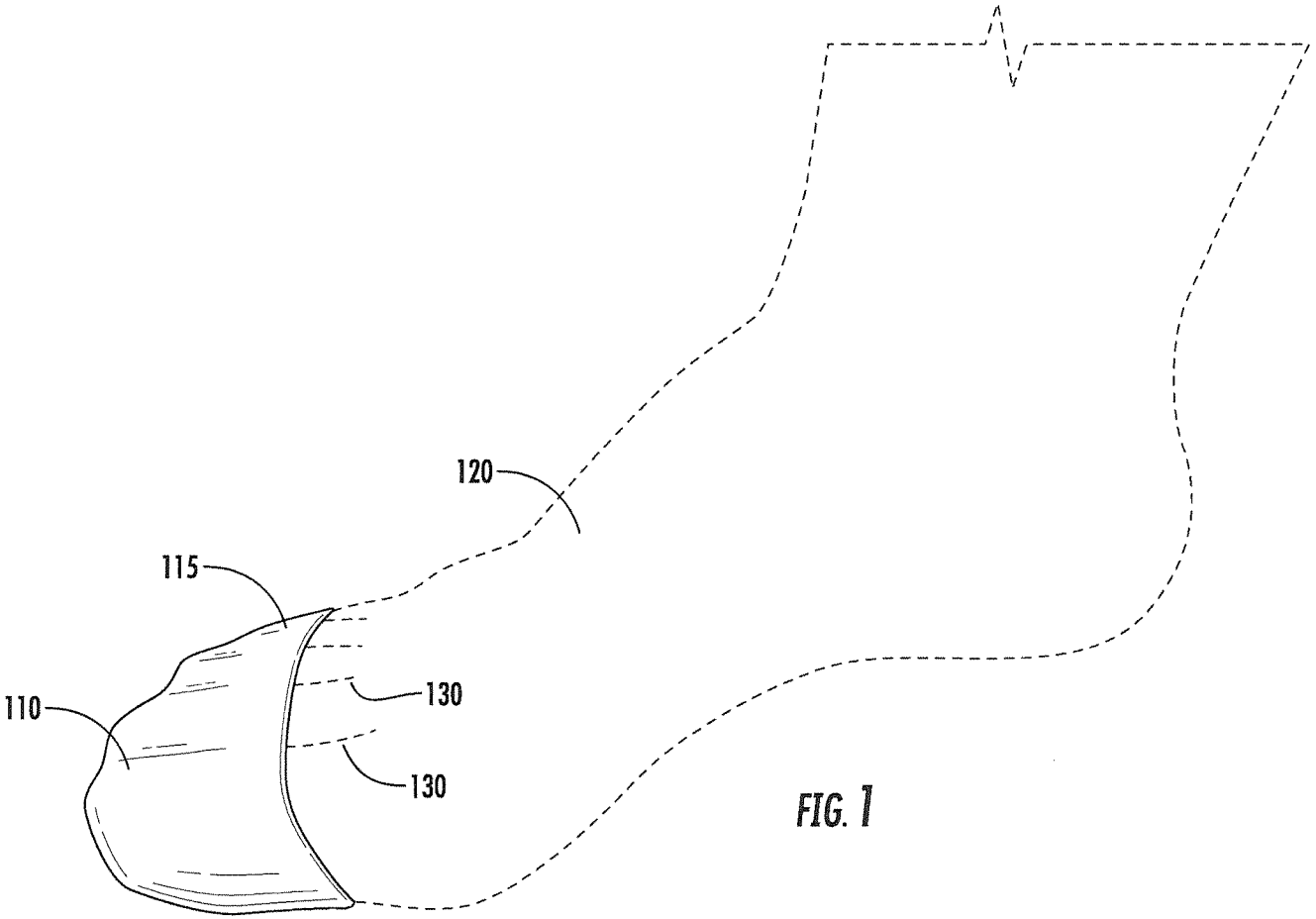
FIG. 1 is a front perspective view of the toe coverlet on a foot in accordance with some embodiments of the present inventive concept.
Figure 2:
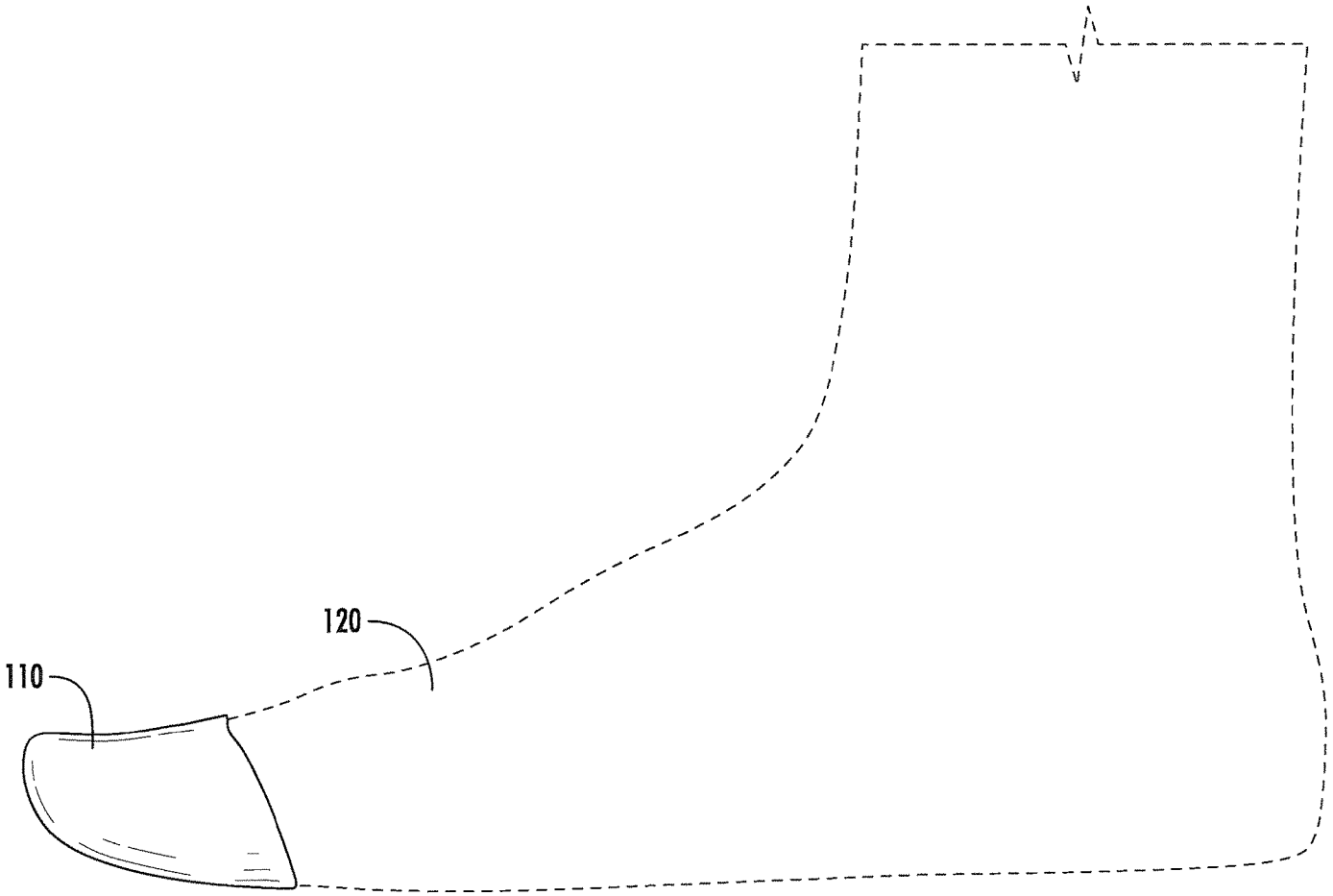
FIG. 2 is a first side view of the toe coverlet on the foot illustrated in FIG. 1 in accordance with some embodiments of the present inventive concept.
Figure 3:
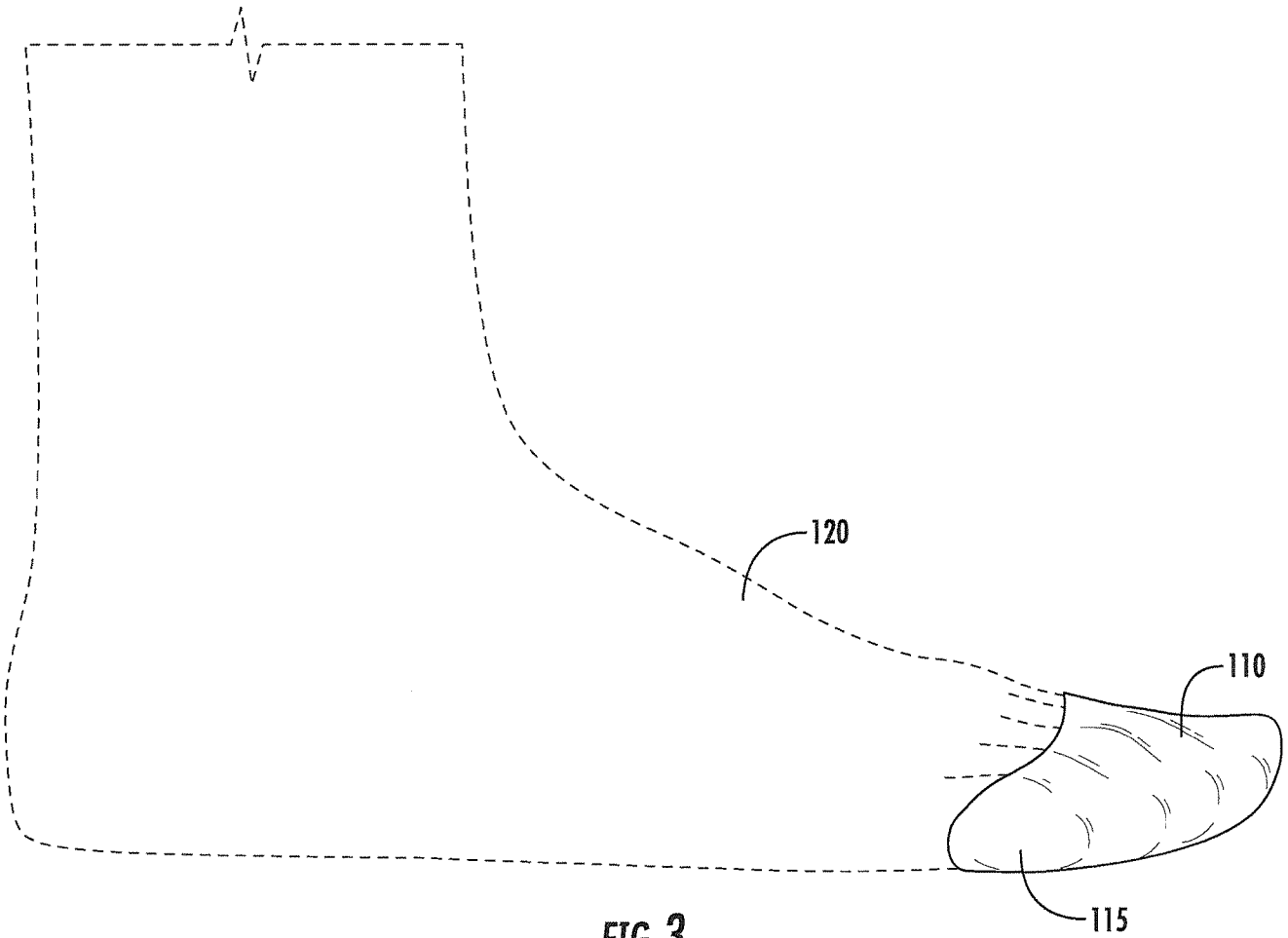
FIG. 3 is an opposing side view of FIG. 2 of the toe coverlet on the foot in accordance with some embodiments of the present inventive concept
Figure 4:
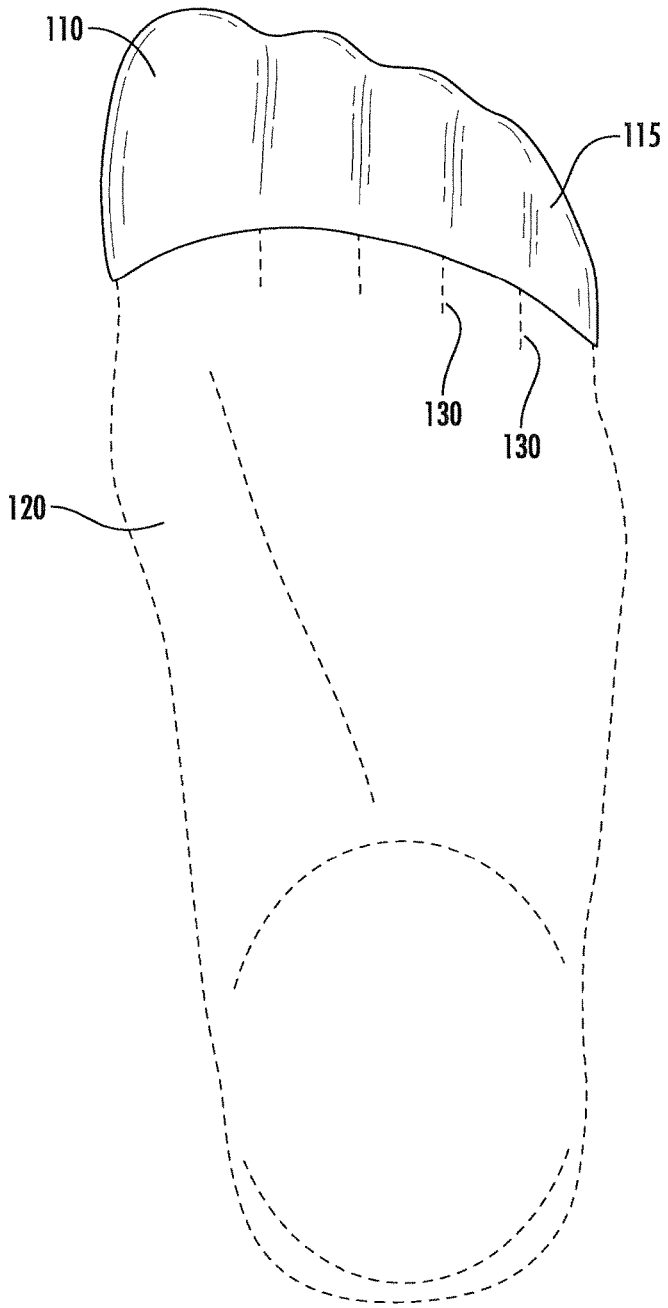
FIG. 4 is a top view of the toe coverlet on the foot illustrated in FIG. 1 in accordance with some embodiments of the present inventive concept.
Figure 5:
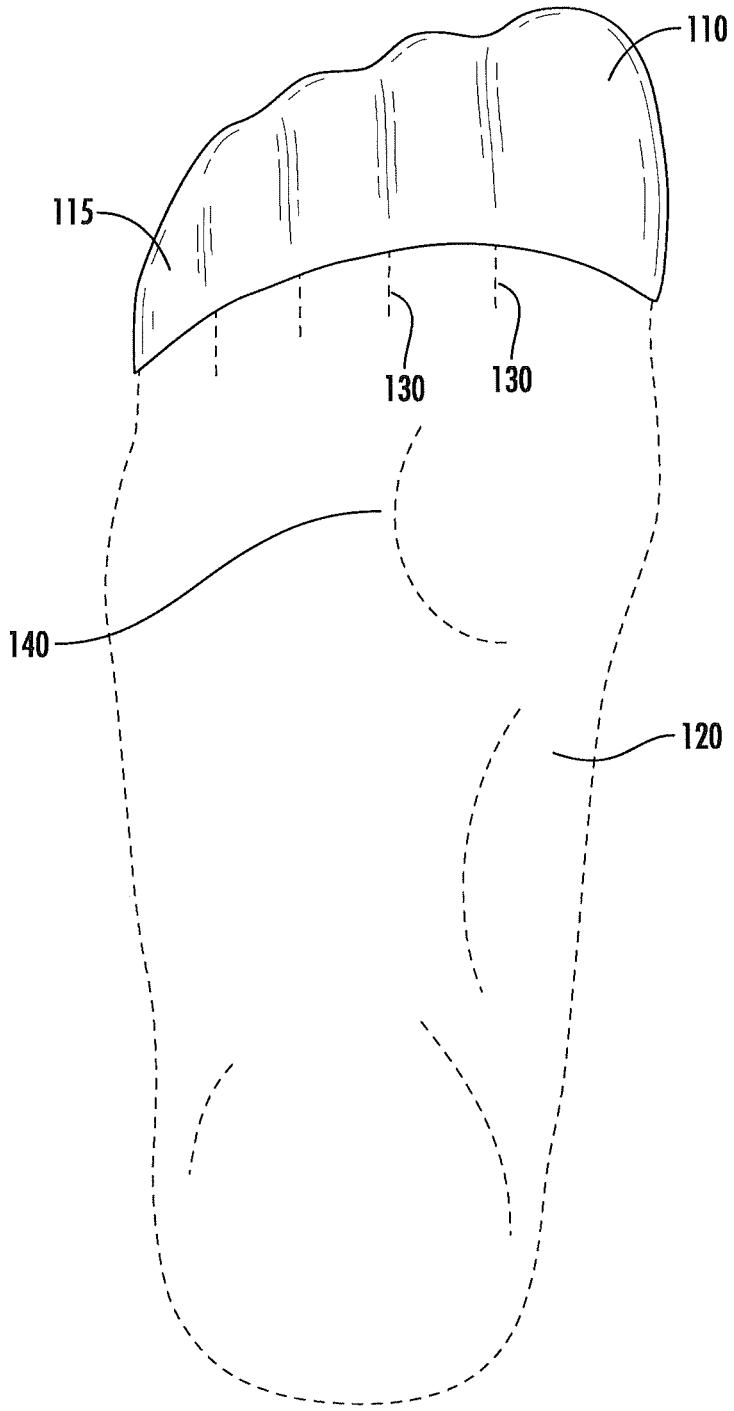
FIG. 5 is a bottom view of the toe coverlet on the foot illustrated in FIG. 1 in accordance with some embodiments of the present inventive concept.

FIG. 1 is a front perspective view of the toe coverlet on a foot in accordance with some embodiments of the present inventive concept. FIGS. 2 through 5 are first and second side views, a top view and a bottom view, respectively, of the toe coverlet on the foot illustrated in FIG. 1 in accordance with some embodiments of the present inventive concept. Referring first to FIG. 1, the toe coverlet 110 fits over the toes of the foot 120 and just barely wraps around and covers the pinky toe 115. This aspect of the present inventive concept is clearly illustrated in FIGS. 3-5. As further illustrated, the toe coverlet 110 does not come up high enough on the foot 120 to cover the tops of the digits of the toes 130. In other words, the tops of the digits of the toes 130 (or spacing therebetween) are free of the toe coverlet 110, which as discussed further below allows the toe coverlet 110 to be hidden by a very low profile shoe.

As discussed above and illustrated in FIG. 5, the toe coverlet 110 is designed such that it does not extend under the ball 140 of the foot 120. This aspect of the present inventive concept allows the toe coverlet to remain low profile as well as protect any paint that may on the nails of the toes, but helps possibly avoid the foot 120 slipping while in the shoe. In other words, the ball of the foot 140 is exposed and, therefore, provides a gripping function in the shoe.

It will be understood that FIGS. 1 through 5 illustrate some embodiments of the present inventive concept; however, embodiments of the present inventive concept are not limited thereto. For example, the toe coverlet 110 may be enlarged or made smaller than shown as long as it remains low profile, exposes the upper portion of the toe digits and does not extend under the ball of the foot. For example, the toe coverlet 110 may be offered as a one size fits most product or may be offered in various sizes for children and adults without departing from the scope of the present inventive concept.

Figure 11A:
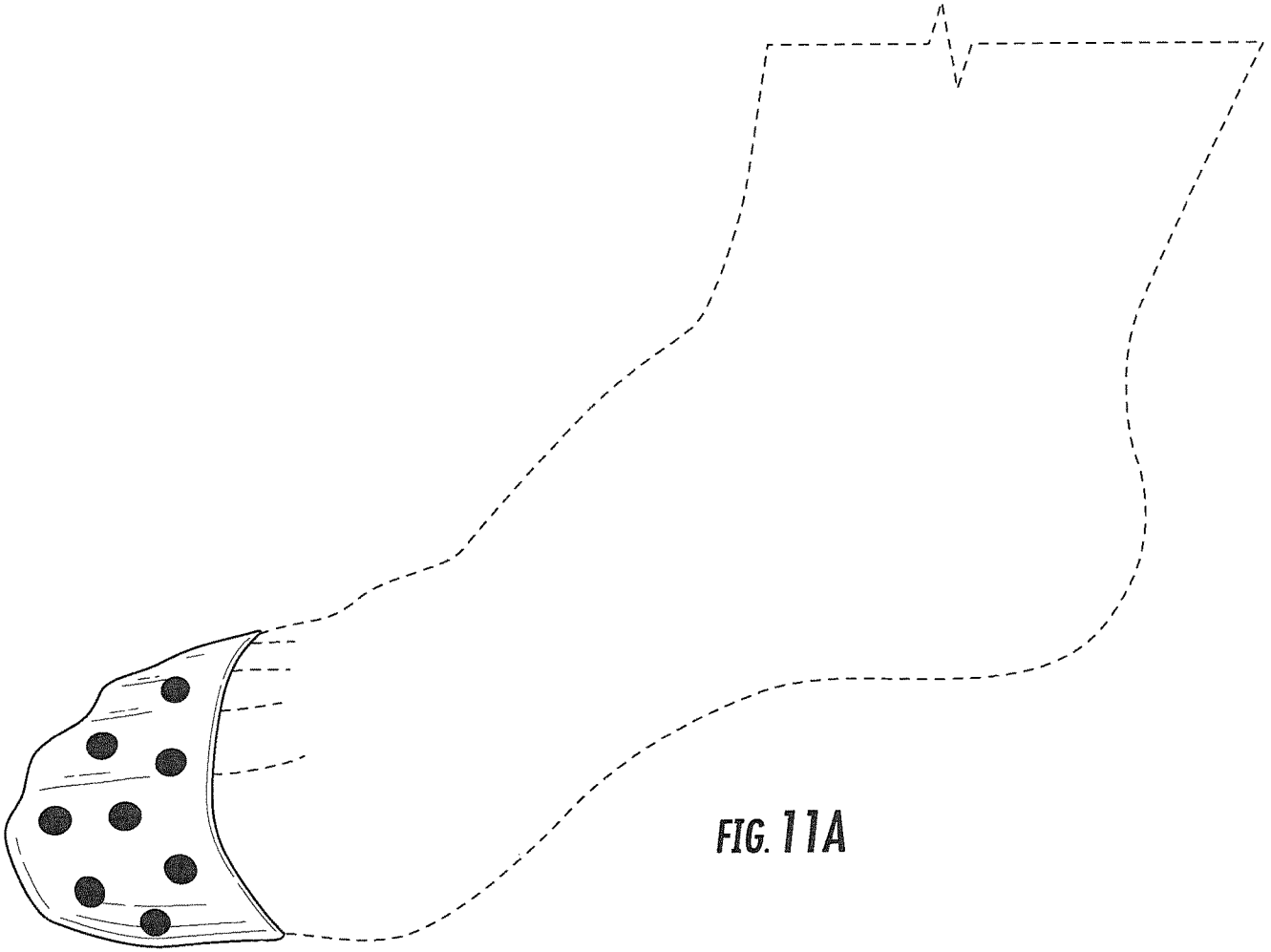
FIGS. 11A through 11C are perspective views of the toe coverlet including various example patterns in accordance with some embodiments of the present inventive concept.
Figure 11B:
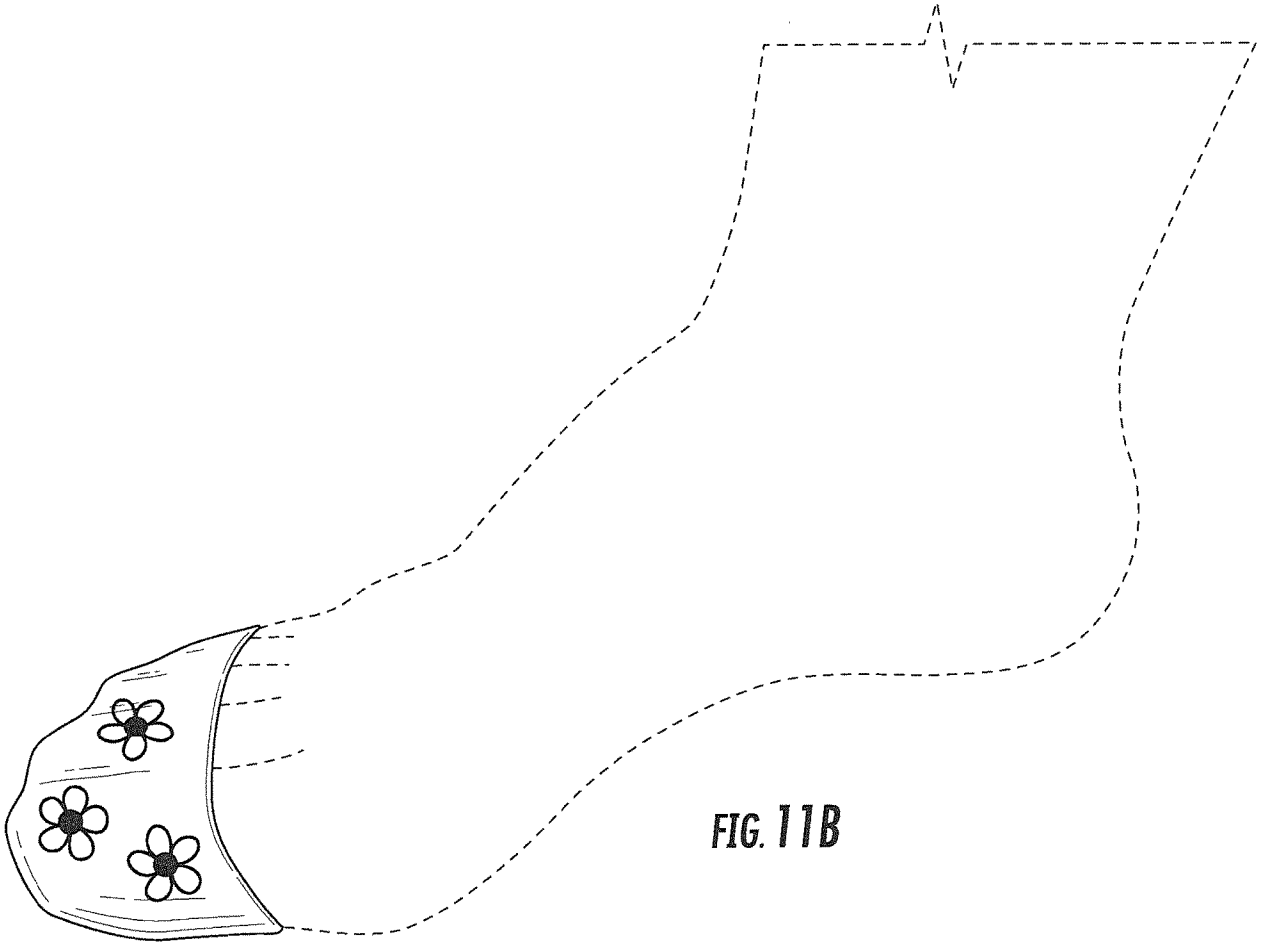
Figure 11C:
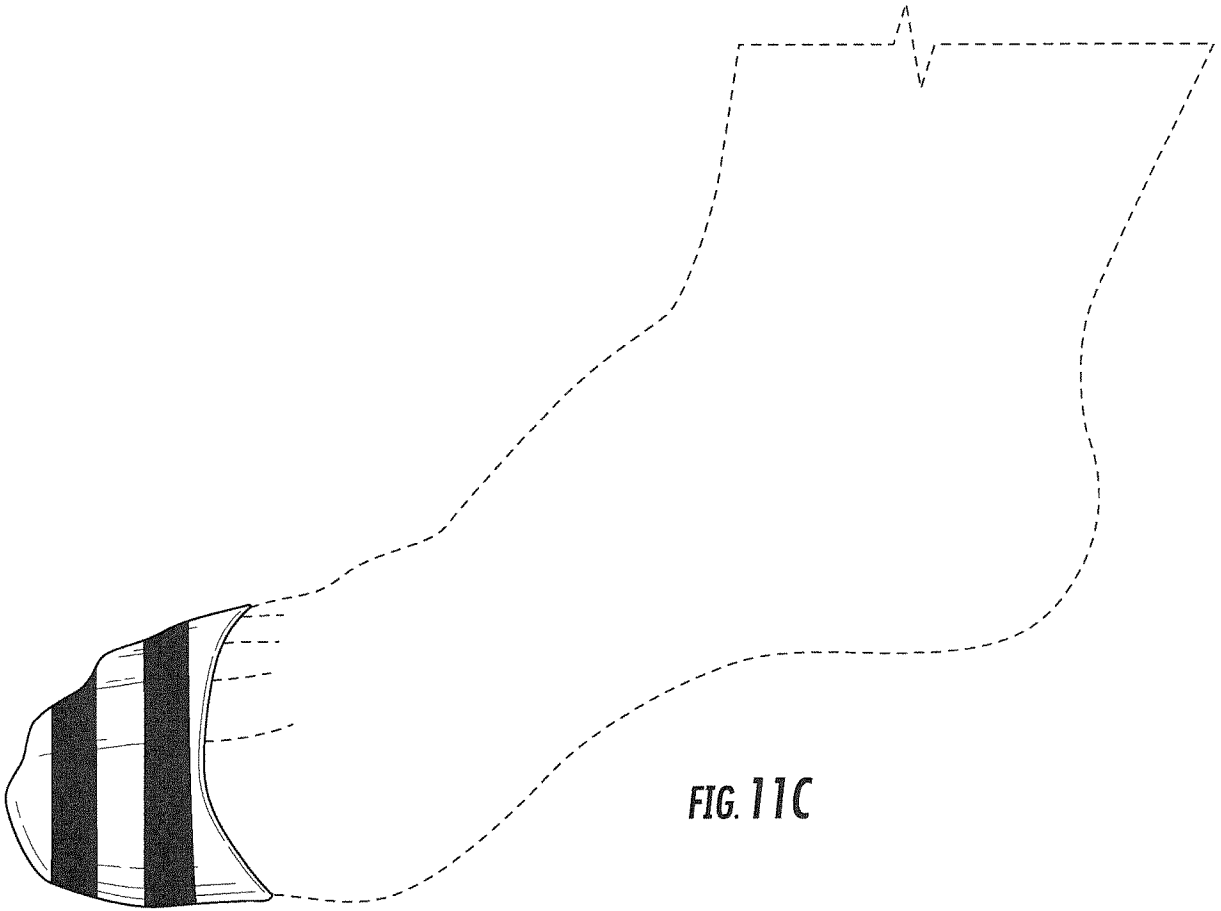

The toe coverlet 110 may be offered in various colors and patterns. For example, as illustrated in FIGS. 11A through 11C, the patterns may include polka dots (FIG. 11A), flowers (FIG. 11B) and stripes (FIG. 11C). It will be understood that these patterns are provided for example only and that any pattern may be used without departing from the scope of the present inventive concept. Similarly, the toe coverlet 110 may be offered in various fabrics including, but not limited to, cotton, nylon, spandex or a combination thereof.

Figure 6:
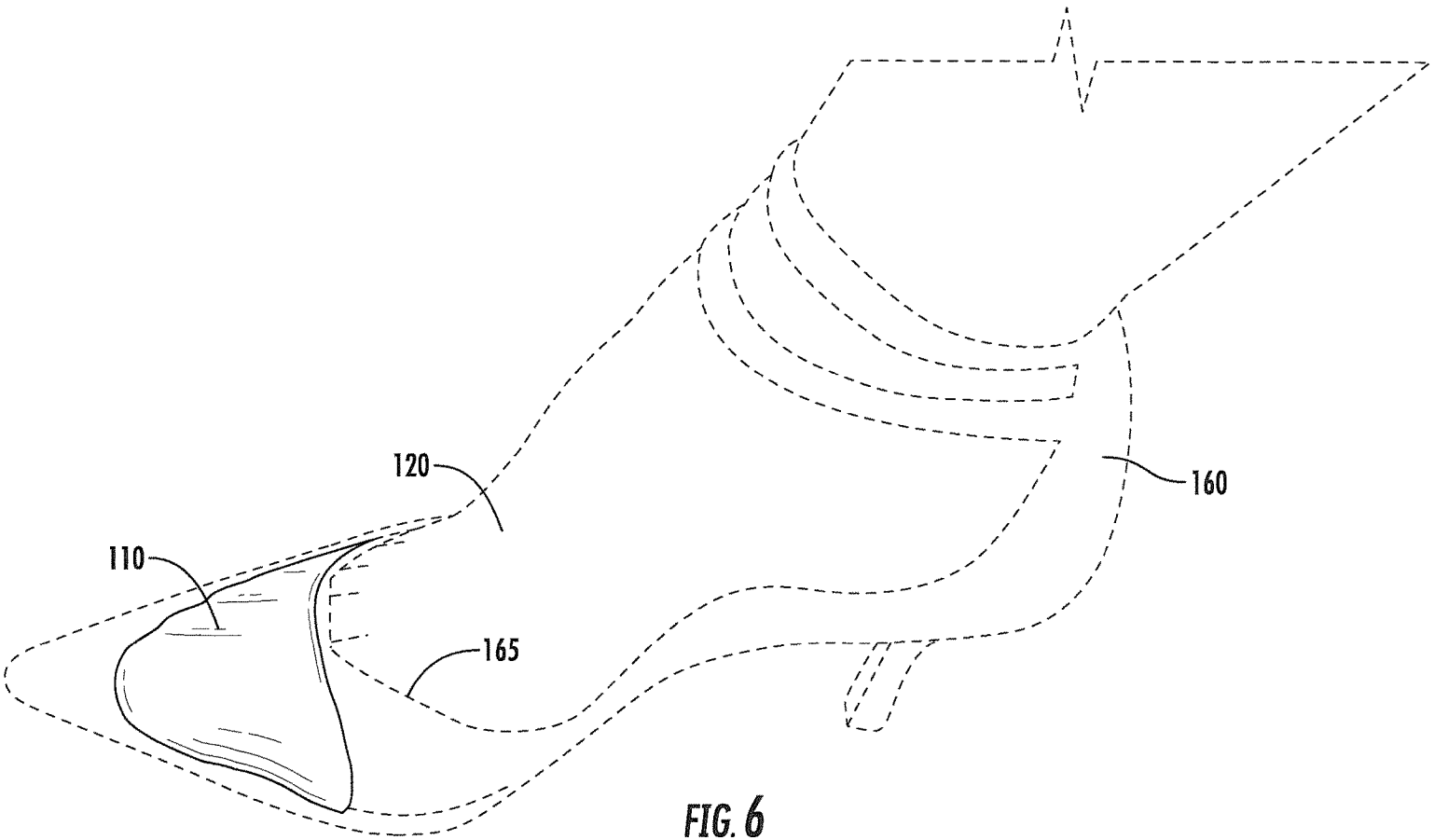
FIG. 6 is a front perspective environmental view of the toe coverlet illustrating the toe coverlet on a foot inside an example shoe in accordance with some embodiments of the present inventive concept.
Figure 7:
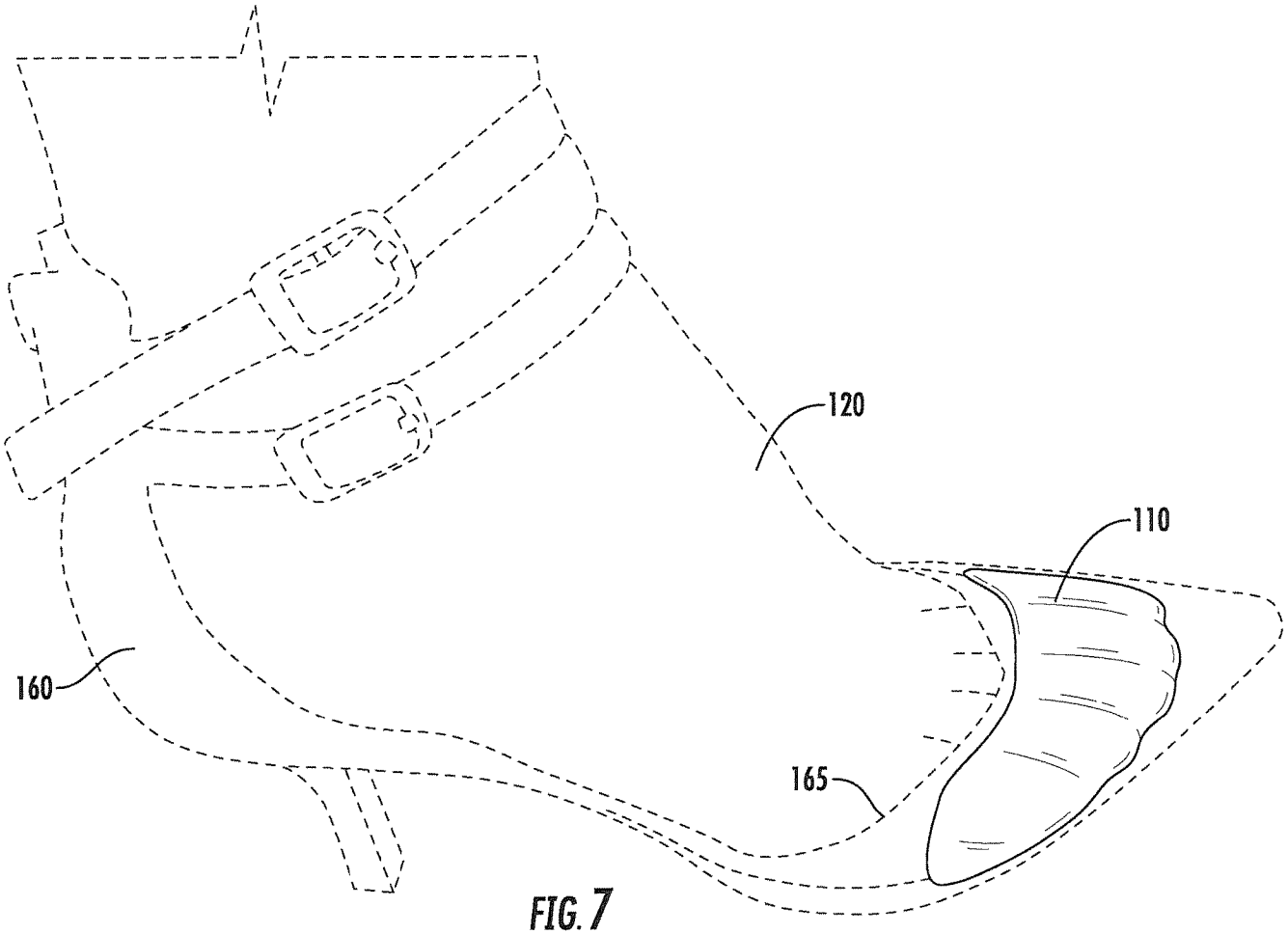
FIG. 7 is a perspective side view of the toe coverlet in the shoe illustrated in FIG. 6 in accordance with some embodiments of the present inventive concept.
Figure 8:
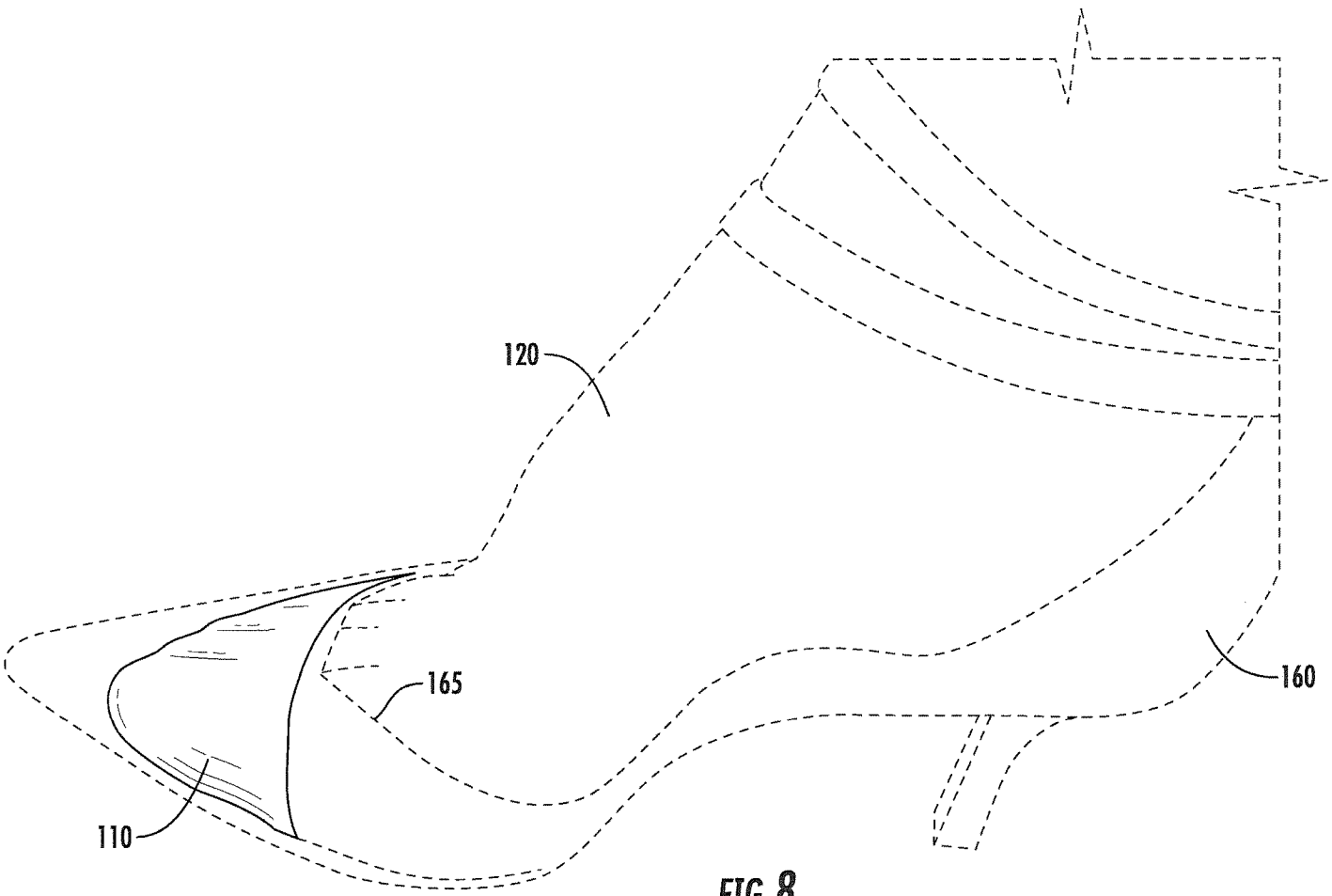
FIG. 8 is an opposing side perspective view of FIG. 7 in accordance with some embodiments of the present inventive concept.
Figure 9:
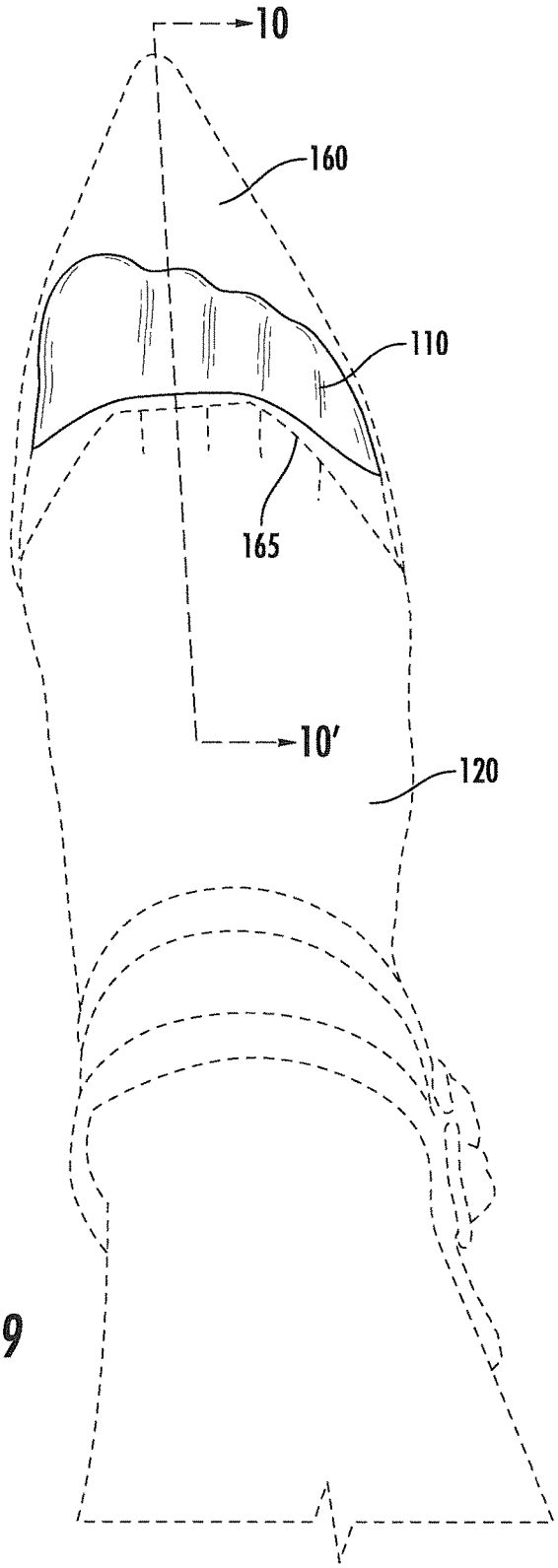
FIG. 9 is a top view of FIG. 7 in accordance with some embodiments of the present inventive concept.

FIG. 6 is a front perspective environmental view of the toe coverlet discussed above inside an example shoe in accordance with some embodiments of the present inventive concept. FIGS. 7 through 9 are first and second side views and a top view, respectively, of FIG. 7 in accordance with some embodiments of the present inventive concept. As illustrated in FIG. 6, when the toe coverlet 110 is positioned on the toes of the foot 120, the toe coverlet 110 is not visible above the perimeter 165 of the shoe 160. Thus, the toe coverlet 110 can be worn on the foot 120 and be invisible inside the shoe 160.

Figure 10:
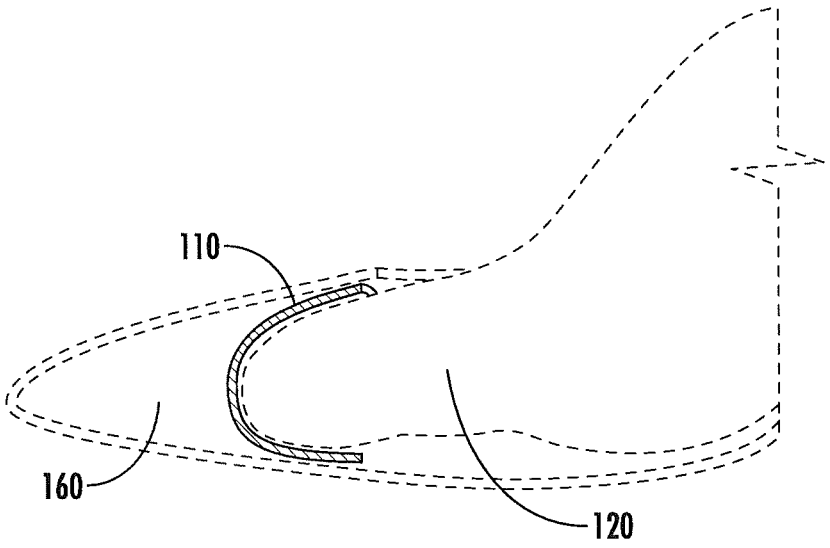
FIG. 10 is a cross section along the line 10-10' of FIG. 9 illustrating the toe coverlet on the foot in an example shoe.

Referring now to FIG. 10, a cross section along the line 10-10' of FIG. 9 illustrating the toe coverlet on the foot in an example shoe will be discussed. As illustrated in FIG. 10, the toe coverlet 110 positioned on the toes inside the shoe is fully within the shoe and nothing is visible outside the perimeter thereof.

Figure 12:
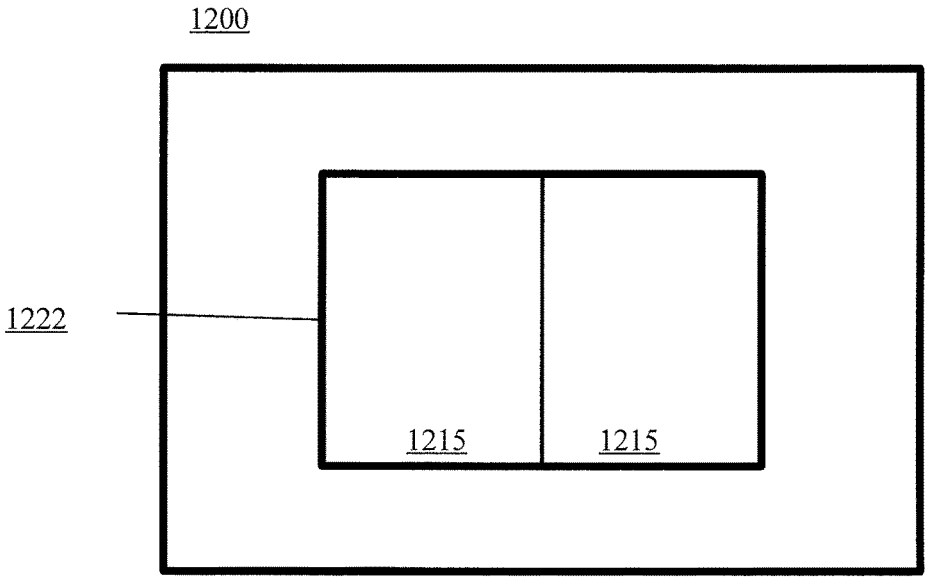
FIG. 12 is a diagram illustrating a system including toe coverlets in accordance with some embodiments of the present inventive concept.

Referring now to FIG. 12, a packaging system that may be used for toe coverlets in accordance with some embodiments will be discussed. As illustrated in FIG. 12, two or more pairs of toe coverlets 1215 may be provided in a housing 1200. In some embodiments, the housing 1200 may include a window 1222 that allows the pairs of toe coverlets 1215 positioned in the housing 1200 to be seen. The housing 1200 may be decorative packaging to appeal to purchasers of the system and can be made of any material suitable. For example, the housing may be one of plastic and cardboard. For example, in some embodiments two pairs of toe coverlets, one black pair and one nude pair may be provided in a decorative packaging and visible through the window 1222.

Various embodiments were described herein with reference to the accompanying drawings, in which embodiments of the inventive concept are shown. This inventive concept may, however, be embodied in many different forms and should not be construed as limited to the embodiments set forth herein; rather, these embodiments are provided so that this disclosure will be thorough and complete, and will fully convey the scope of the inventive concept to those skilled in the art.

Like numbers refer to like elements throughout. The terminology used herein is for the purpose of describing particular embodiments only and is not intended to be limiting of the inventive concept. As used herein, the singular forms "a", "an" and "the" are intended to include the plural forms as well, unless the context clearly indicates otherwise. Well-known functions or constructions may not be described in detail for brevity and/or clarity.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive concept. Moreover, as used herein, the term "and/or" includes any and all combinations of one or more of the associated listed items.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of this specification and the relevant art and will not be interpreted in an idealized or overly formal sense expressly so defined herein.

As used herein, the terms "comprise", "comprising", "comprises", "include", "including", "includes", "have", "has", "having", or variants thereof are open-ended, and include one or more stated features, integers, elements, steps, components or functions but does not preclude the presence or addition of one or more other features, integers, elements, steps, components, functions or groups thereof. Furthermore, if used herein, the common abbreviation "e.g.", which derives from the Latin phrase exempli gratia, may be used to introduce or specify a general example or examples of a previously mentioned item, and is not intended to be limiting of such item. If used herein, the common abbreviation "i.e.", which derives from the Latin phrase id est, may be used to specify a particular item from a more general recitation.

Many different embodiments were disclosed herein, in connection with the description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed example embodiments of the inventive concept. However, many variations and modifications can be made to these embodiments without substantially departing from the principles of the present inventive concept. Accordingly, although specific terms are used, they are used in a generic and descriptive sense only and not for purposes of limitation, the scope of the inventive concept being defined by the following claims.

That which is claimed is:

1. A toe coverlet comprising a flexible material configured to be positioned over toes of a foot such that spacing between the toes of the foot is visible, wherein the flexible material does not extend over the visible spacing between the toes; and wherein the flexible material does not extend onto a ball of the foot or between the toes of the foot.

2. The toe coverlet of claim 1, wherein the flexible material comprises one of cotton, nylon, spandex and a combination thereof.

3. The toe coverlet of claim 1, wherein toe nails on the toes are completely covered by the flexible material of the toe coverlet to provide protection of any paint present on the toe nails.

4. The toe coverlet of claim 1, wherein the flexible material exposes the ball of the foot such that the exposed ball of the foot provides a gripping function for the foot within a shoe.

5. The toe coverlet of claim 1, wherein presence of the toe coverlet on the toes of the foot assist positioning of the foot in a shoe.

6. The toe coverlet of claim 1, wherein the toe coverlet has a crescent shape such that it barely covers a small pink toe on the foot.

7. The toe coverlet of claim 1, wherein the toe coverlet is provided as one of one size fits all, a kid size and an adult size.

8. The toe coverlet of claim 1, wherein the flexible material is provided having patterns thereon.

9. The toe coverlet of claim 1, wherein the flexible material is not visible outside a perimeter of a shoe when the toe coverlet is positioned on the foot in the shoe.

10. The toe coverlet of claim 1, wherein the flexible material just barely wraps around the toes of the foot.

11. A system comprising:

a housing; and a plurality of pairs of toe coverlets positioned in the housing, wherein the plurality of pairs of toe coverlets comprise a flexible material configured to be positioned over toes of a foot such that spacing between the toes of the foot is visible, wherein the flexible material does not extend over the visible spacing between the toes; and wherein the flexible material does not extend onto a ball of the foot or between the toes of the foot.

12. The system of claim 11, wherein the housing includes decorative packaging to appeal to purchasers of the system.

13. The system of claim 12, wherein the decorative packaging comprises one of plastic and cardboard.

14. The system of claim 12, wherein the decorative packaging includes a window on the packaging that allows the plurality of pairs of toe coverlets to be viewed therein.

15. The system of claim 11, wherein the flexible material comprises one of cotton, nylon, spandex and a combination thereof.

16. The system of claim 11, wherein toe nails on the toes are completely covered by the flexible material to provide protection of any paint present on the toe nails.

17. The system of claim 11, wherein the flexible material exposes the ball of the foot such that the exposed ball of the foot provides a gripping function for the foot within a shoe.

18. The system of claim 11, wherein presence of a toe coverlet on the toes of the foot assist positioning of the foot in a shoe.

19. The system of claim 11, wherein the flexible material is not visible outside a perimeter of a shoe when the toe coverlet is positioned on the foot in the shoe.

20. The system of claim 11, wherein the plurality of pairs of toe coverlets have a crescent shape such that the flexible material just barely wraps around the toes of the foot.

* * * * *